US006659668B2

(12) United States Patent
Kinsley et al.

(10) Patent No.: US 6,659,668 B2
(45) Date of Patent: Dec. 9, 2003

(54) PRINTER ACCESS DOOR AND METHOD OF USING SAME

(75) Inventors: Tod A. Kinsley, Tigard, OR (US); Peter G. Hwang, Vancouver, WA (US); Richard E. Berriman, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/017,780

(22) Filed: Oct. 30, 2001

(65) Prior Publication Data

US 2003/0081018 A1 May 1, 2003

(51) Int. Cl.[7] ..... B41J 29/02
(52) U.S. Cl. ..... 400/693; 400/691
(58) Field of Search ..... 400/693, 692, 400/691, 713, 715; 347/138, 152, 108

(56) References Cited

U.S. PATENT DOCUMENTS

| | | | | | |
|---|---|---|---|---|---|
| 4,808,021 | A | * | 2/1989 | Kelly | 400/717 |
| 5,343,223 | A | * | 8/1994 | Tohyama et al. | 347/139 |
| 5,573,235 | A | * | 11/1996 | Asai | 271/121 |
| 6,022,158 | A | * | 2/2000 | Nakayama et al. | 400/613 |
| 6,494,633 | B1 | * | 12/2002 | Crosby et al. | 400/668 |

* cited by examiner

*Primary Examiner*—Andrew H. Hirshfeld
*Assistant Examiner*—Anthony H. Nguyen

(57) ABSTRACT

An ink-jet printer including a housing having an access door and a web. The web includes a first pair of hinge elements pivotally connecting the web and the housing and a second pair of hinge elements pivotally connecting the web and the access door, wherein the first pair of hinge elements and the second pair of hinge elements cooperate for relative movement of the access door toward and away from the housing.

14 Claims, 3 Drawing Sheets

PRINTER ACCESS DOOR AND METHOD OF USING SAME

BACKGROUND OF THE INVENTION

The present invention relates generally to inkjet printers and, more particularly, to access doors, or access doors, utilized in such printers.

Printers of various types are operated daily in thousands of business organizations, university campuses and homes. The typical ink-jet printer utilizes an access door pivotally attached to the printer housing to facilitate access to the printer interior for print cartridge replacement or for clearing paper jams. Generally, the access door opens upwardly in relation to the housing and, of course, this factor mandates that there be sufficient clearance for the door as it moves to the open position.

With ongoing development, printers are becoming more efficient and more compact. Thus, in some cases, a user may desire to place a printer on a shelf but is limited because vertical clearance is not available to accommodate the printer while the access door is open for servicing. The alternatives are to place the device on another surface or to remove it from the shelf when access to printer components is necessary.

In view of the foregoing, it would be desirable to have an ink-jet printer that is suitable for use on a shelf or where vertical height is limited. Such a printer would enable access to print cartridges or to paper jams without requiring the vertical clearance of conventional printers.

DISCLOSURE OF THE INVENTION

According to the present invention, there is provided an ink-jet printer including a housing having an access door and a web. The web includes a first pair of hinge elements pivotally connecting the web and the housing, and a second pair of hinge elements pivotally connecting the web and the access door, wherein the first pair of hinge elements and the second pair of hinge elements cooperate for relative movement of the access door toward and away from the housing.

The present invention affords several advantages. For example, it is not necessary to provide vertical clearance for a simple hinged, conventional door since the dual pairs of hinges enable the access door to arc upwardly and back in relation to the housing, within a relatively smaller envelope. Thus, print cartridges and paper jams are accessible while conservation of valuable shelf space is achieved.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
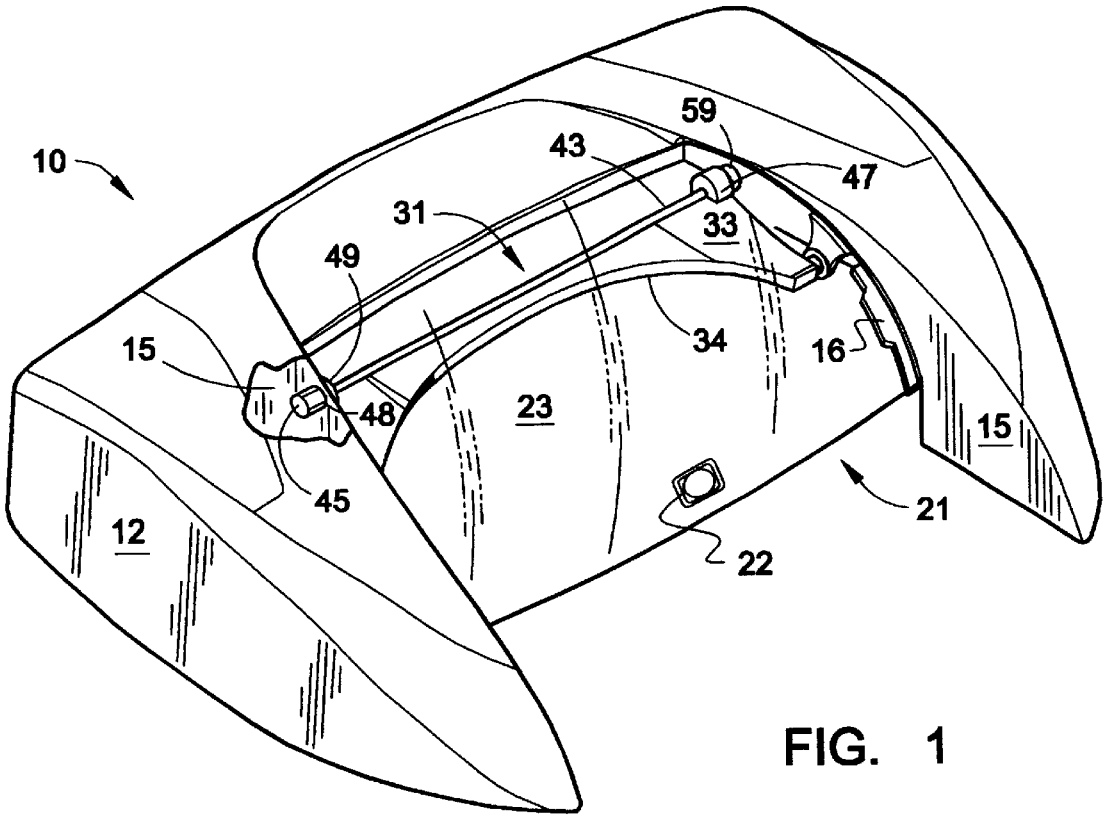
FIG. 1 is a front elevational, partially cut away, view of a printer that is constructed according to the present invention showing the access door in a closed position.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to embraced within their scope.

In the following detailed description and in the several figures of the drawings, like elements are identified with like reference numerals.

Referring now to the drawings, there is shown a novel printer 10 that is constructed according to the present invention. The printer 10 includes a housing 12 having a forward extending interior wall 15. An access door 21 is pivotally attached to the interior wall 15 for rotation from a closed position to an open position. When access to the printer is desired for cartridge replacement or clearance of a paper jam, the user simply rotates the access door into the open position. In the process, the access door 21 arcs back and over the top of the housing 12. In this manner, access to printer components is enabled within a lower vertical height, as compared to conventional printers.

Figure 2:
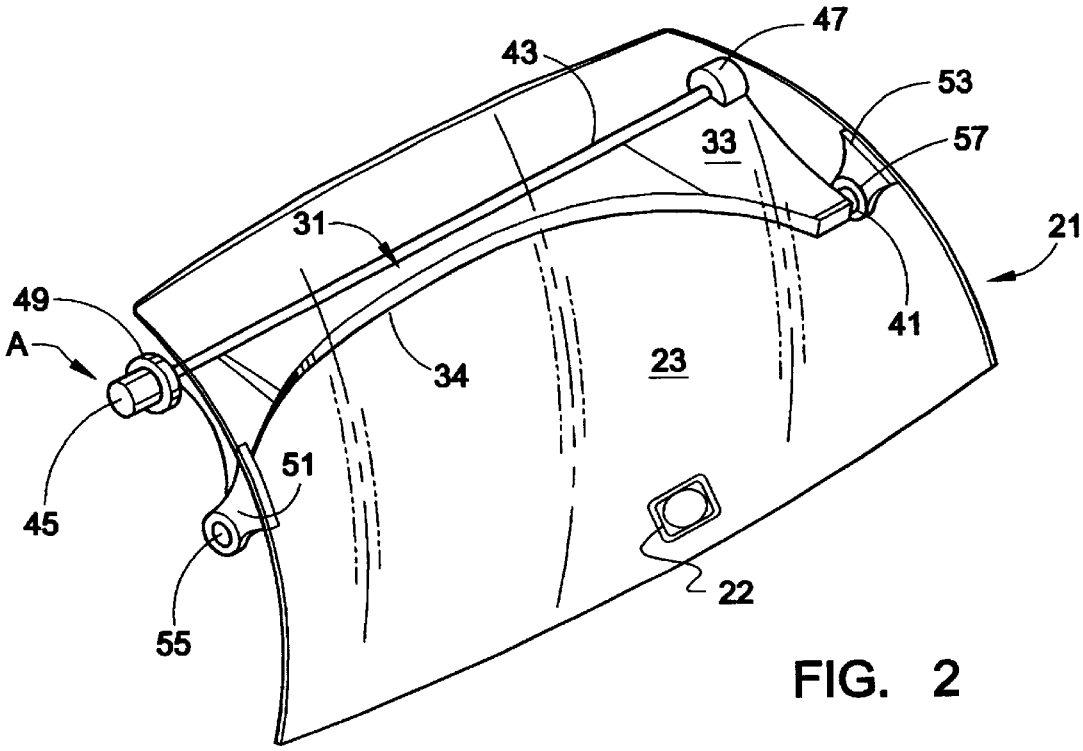
FIG. 2 is a front elevational view of the access door shown in FIG. 1 showing the relationships between the access door and hinge elements when the access door is in the closed position.

The printer 10 use, or operational, condition will first be considered with reference to FIGS. 1 and 2. In this case, the access door 21 is closed and the hinge elements associated with the door are disposed as indicated generally by the arrow A (FIG. 2). The access door includes a curvilinear shell 23. This shell rests on a pair of positioners or locators, such as the locator 16, mounted on the interior wall 15, when the door is closed. A button 22, located on the front of the door 21, is useful as the door is moved from one position to another.

Figure 6:
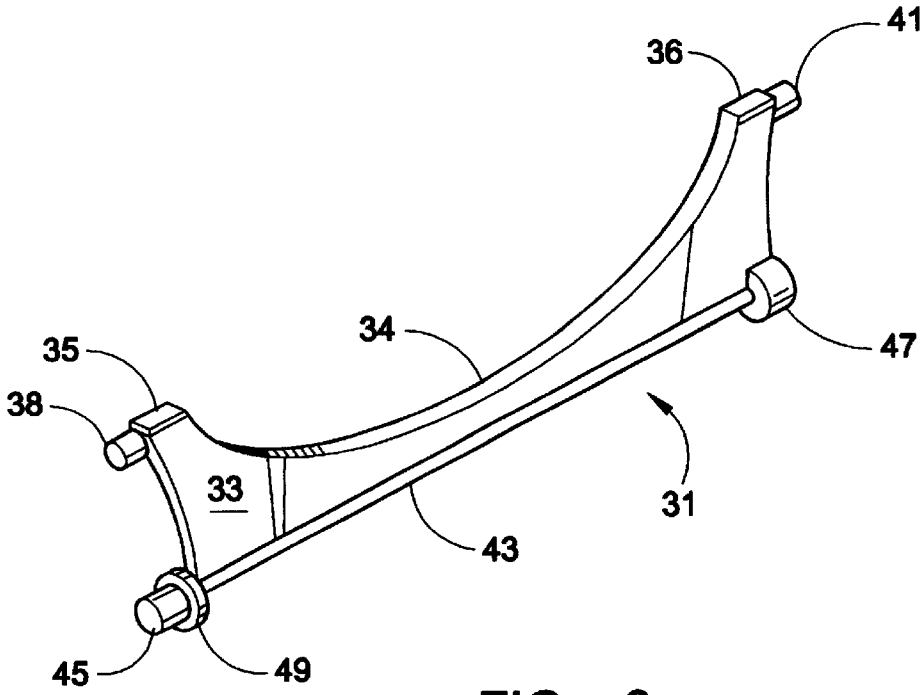
FIG. 6 is a perspective view of a hinging apparatus and some of the hinge elements of the printer of FIG. 1.

Pivotal movement of the access door 21, relative to the housing 12, is accomplished by a hinging apparatus 31, shown best in FIG. 6. The apparatus 31 includes a strengthening member 43 attached to an elongated lift bar, or web 33. The strengthening member 43 supports a first pair of hinge elements, indicated generally by reference numeral 62 in FIG. 4, that include a pivot pin 45, having a collar 49, mounted at one end of the member 43 and a boss, or pivot pin receiver 47, mounted at the other end. The interior wall 15 includes a receiver 48 for receipt of the pivot pin 45 for rotational movement therewithin. At the opposite end of the member 43, a pivot pin 59 projects into the receiver 47 for rotational movement therewithin. It will be noted that cooperation between the first pair of hinge elements, and their respective housing mounted elements, enable rotational movement of the web 33 relative to the housing 12.

Figure 4:
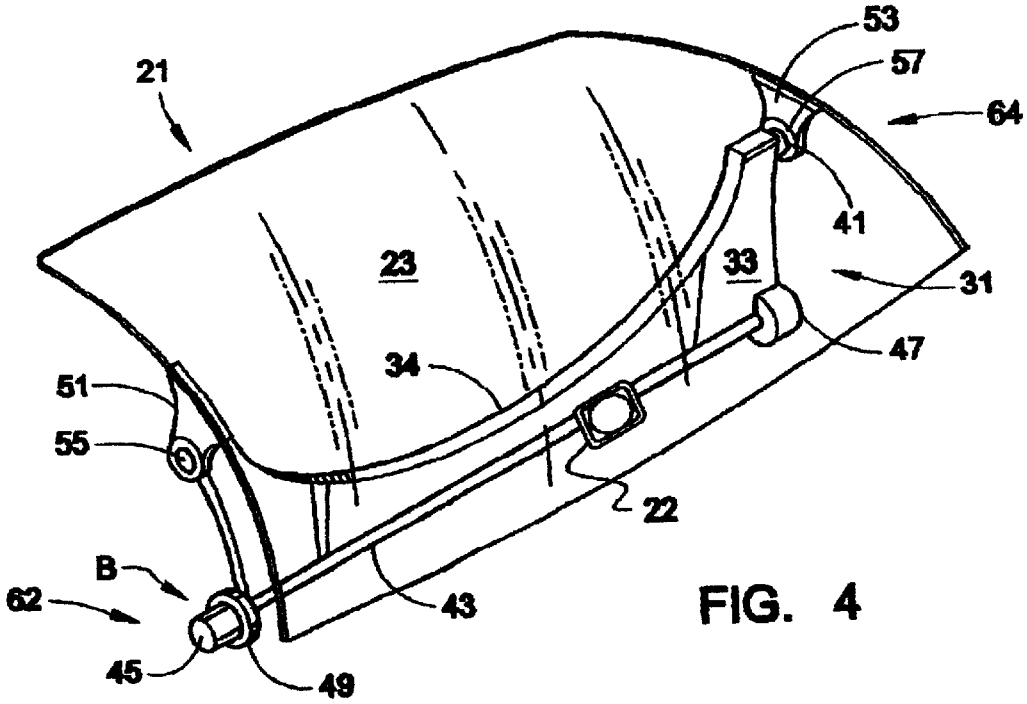
FIG. 4 is a front elevational view of the printer of FIG. 1 showing the relationships between the access door and hinge elements when the access door is in the open position.

In a like manner, rotational movement of the web 33 relative to the access door 21 is accomplished by means of a second pair of web mounted hinge elements, indicated generally by reference numeral 64 in FIG. 4, that act in cooperation with access door 21 mounted hinge elements. In this regard, the web 33 includes an arcuate shaped bridge 34 disposed between a pair of pivot pin receivers 51 and 53. The receivers are attached at a flat surface, such as the surfaces 35 and 36, to the underside of the shell 23.

Openings 55 and 57 are formed in the receivers 51 and 53, respectively. These openings receive pivot pins, such as the pins 38 and 41, respectively, for enabling pivotal movement of the access door 21 relative to the web 33.

Figure 3:
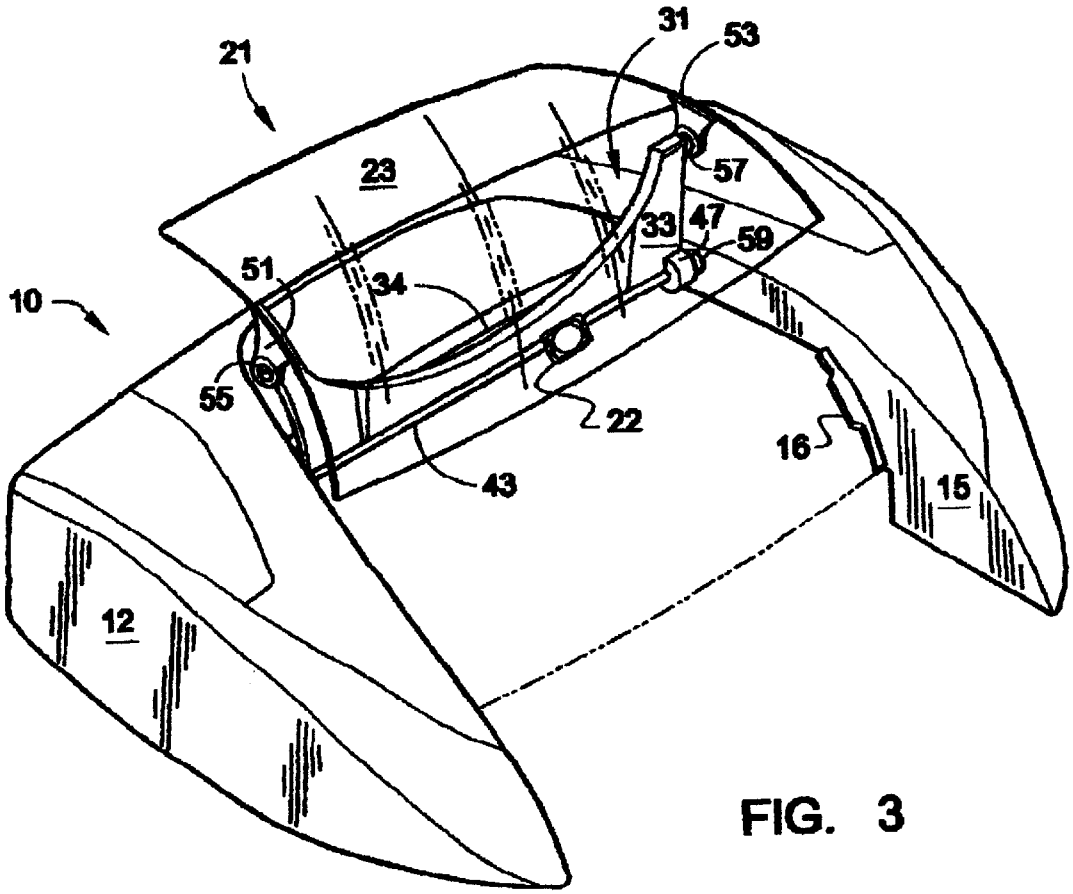
FIG. 3 is a front elevational view of the printer of FIG. 1 showing the access door in an open position.

As set forth above, the access door 21 is pivotally mounted by means of two sets of pivots to enable movement within a small envelope. The condition of the printer 10, with the access door 21 in the opened position, is shown in FIGS. 3 and 4. The changed relationship, as compared to that shown in FIG. 2, between the hinging apparatus 31 and the access door 21 is shown generally by the arrow B (FIG. 4).

Figure 5:
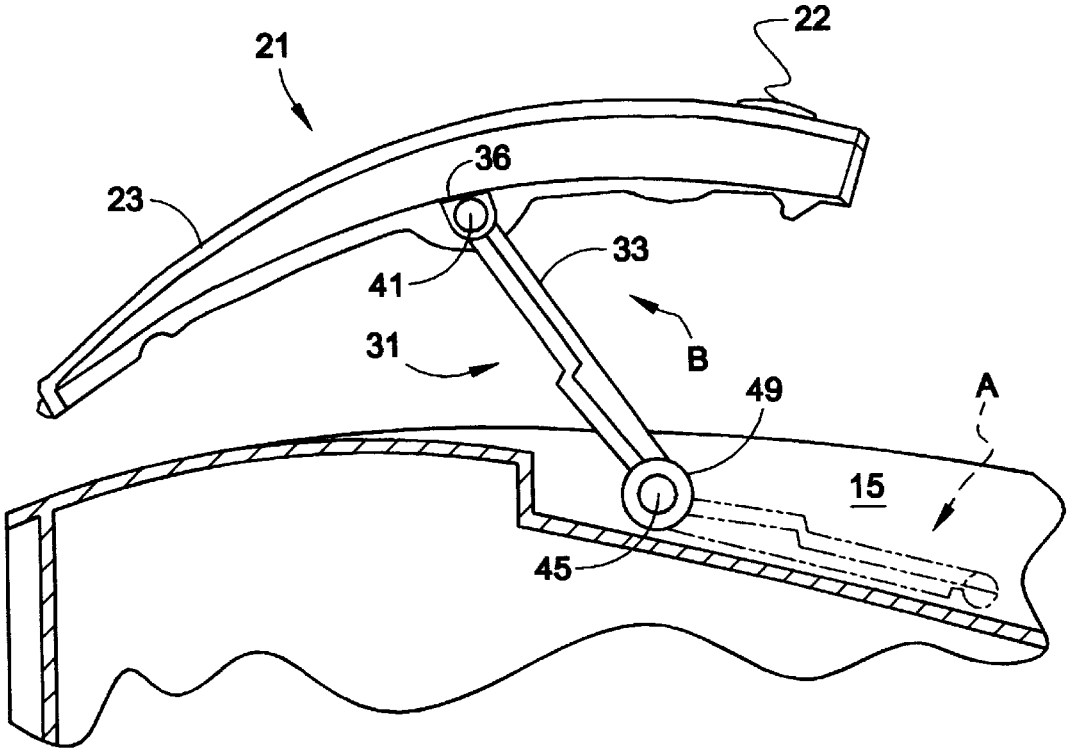
FIG. 5 is a partial side elevational view of the printer of FIG. 1 showing the relationships of access door and hinge elements in the access door open and closed positions.

Finally, the relative positions of the access door 21 and the housing 12 are shown in FIG. 5 in which the open access door position is indicated generally by the arrow A and the closed position is shown in phantom generally by the arrow B.

It will be evident that there are additional embodiments and applications that are not disclosed in the detailed description but which clearly fall within the scope of the present invention. The specification is, therefore, intended not to be limiting, and the scope of the invention is to be limited only by the following claims.

What is claimed is:

1. An ink-jet printer, comprising:

a housing;

an access door;

a web, said web including a first pair of hinge elements pivotally connecting said web and said housing and a second pair of hinge elements pivotally connecting said web and said access door, wherein said first pair of hinge elements and said second pair of hinge elements cooperate for relative movement of said access door toward and away from said housing.

2. The printer according to claim 1, wherein said web includes a plurality of pivot pins and a pivot pin receiver.

3. The printer according to claim 1, wherein said first pair of hinge elements and said second pair of hinge elements are mounted on said web in spaced apart relationship.

4. The printer according to claim 1, wherein said first pair of hinge elements includes a pivot pin and said housing includes a receiver for receipt therein of said pivot pin.

5. The printer according to claim 1, wherein said housing includes a pivot pin and said first pair of hinge elements includes a boss for receipt therein of said pivot pin.

6. The printer according to claim 1, wherein each one of said pair of hinge elements includes a flat surface affixed to said access door.

7. The printer according to claim 1, wherein each one of said second pair of hinge elements includes a pivot pin and said housing includes a pair of receivers for receipt therein of said pivot pins.

8. The printer according to claim 1, wherein said access door is curvilinear in shape.

9. The printer according to claim 1, wherein said web is elongated in configuration, having a pivot pin mounted at opposite ends thereof.

10. The printer according to claim 9, wherein said web further includes a pivot pin and a pivot pin receiver mounted at opposite ends thereof.

11. The printer according to claim 1, wherein said housing includes a pair of locators for supporting said access door when said access door is rotated toward said housing.

12. A method of affording access to printer components, comprising the steps of:

providing a printer having a housing, an access door and a web, said web including a first pair of hinge elements and a second pair of hinge elements;

pivotally connecting said first pair of hinge elements and said housing; and pivotally connecting said second pair of hinge elements and said access door.

13. The method according to claim 12, wherein said moving step includes the steps of rotating said access door relative to said web and rotating said web relative to said housing.

14. A printing device, comprising:

a housing;

an access door;

a bar, said bar including a first pair of hinge elements connecting said bar and said housing and a second pair of hinge elements connecting said bar and said access door, wherein said first pair of hinge elements and said second pair of hinge elements allow rotational movement of the bar with respect to both said access door and said housing.

* * * * *